United States Patent [19]

Nülle et al.

[11] Patent Number: 4,990,040

[45] Date of Patent: Feb. 5, 1991

[54] BRACING DEVICE FOR PRESERVING THE SHAPE OF LARGE COILS

[75] Inventors: Henner Nülle, Bolivar, Ohio; Edmund Munk, Oberstenfeld, Fed. Rep. of Germany

[73] Assignee: Werzalit-Werke, J.F. Werz KG, Oberstenfeld, Fed. Rep. of Germany

[21] Appl. No.: 690,572

[22] Filed: Jan. 10, 1985

[30] Foreign Application Priority Data

Aug. 10, 1984 [EP] European Pat. Off. ..... 84109561.5

[51] Int. Cl.[5] ..... B65D 85/67

[52] U.S. Cl. ..... 410/47; 206/413; 206/416; 242/68.6

[58] Field of Search ..... 410/46, 47, 121, 154, 410/155, 156; 242/68.5, 68.6, 118.31, 118.61; 206/413–416, 408, 509; 229/5.5, 5.8

[56] References Cited

U.S. PATENT DOCUMENTS

| | | | |
|---|---|---|---|
| 3,115,969 | 12/1963 | Beaudoin | 206/389 |
| 3,123,020 | 3/1964 | Voissem | 242/118.61 |
| 3,627,220 | 12/1971 | Vogel | 242/68.6 |
| 3,700,099 | 10/1972 | Heroux | 206/415 |
| 3,722,731 | 3/1973 | McCormick et al. | 206/509 |
| 3,856,178 | 12/1974 | Norgaard | 206/509 |
| 3,878,940 | 4/1975 | Wittebort | 206/416 |
| 4,015,711 | 4/1977 | Mason | 206/416 |

FOREIGN PATENT DOCUMENTS

| | | | |
|---|---|---|---|
| 844633 | 5/1952 | Fed. Rep. of Germany | 242/118.61 |
| 888860 | 5/1957 | United Kingdom | 206/416 |

*Primary Examiner*—Donald T. Hajec

*Attorney, Agent, or Firm*—Michael J. Striker

[57] ABSTRACT

An insertable hub-shaped bracing device for preserving the shape of large coils, consisting of a circular disk having a U-shaped cross-section and a cylindrical opening in its center, the disk being insertable in the cylindrical cores of large coils.

2 Claims, 1 Drawing Sheet

FIG. 1
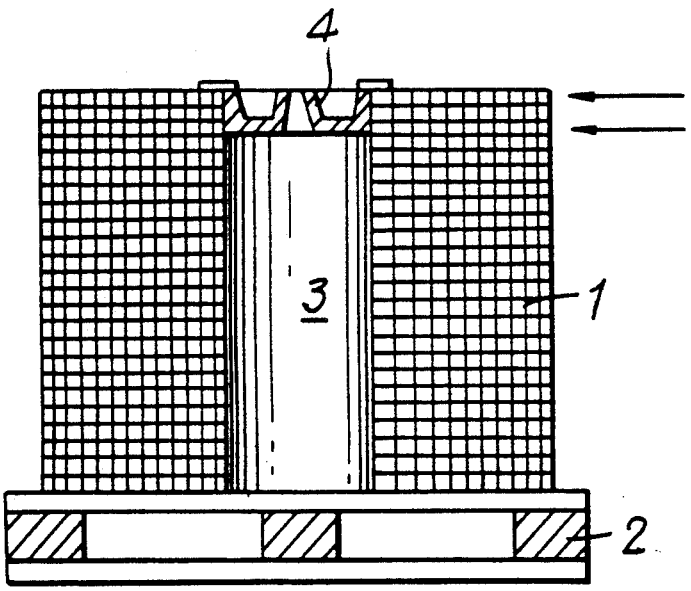
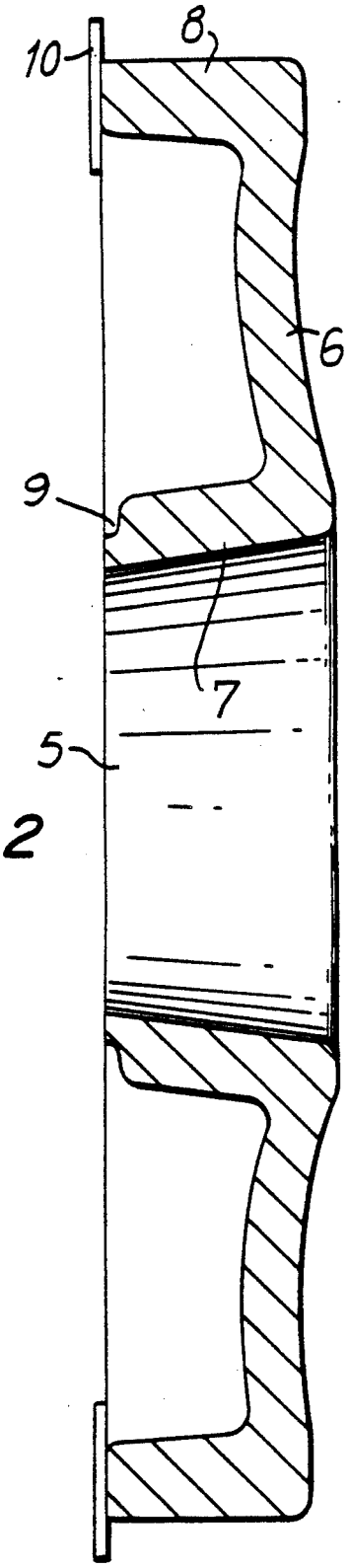
FIG. 2
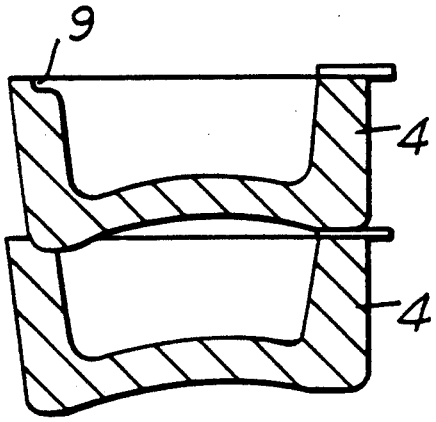
FIG. 3

BRACING DEVICE FOR PRESERVING THE SHAPE OF LARGE COILS

BACKGROUND OF THE INVENTION

The present invention relates to a device for preserving the shape of large coils such as aluminum or steel sheet coils. More particularly, the invention relates to an insertable hub-shaped device which preserves the shape of the cylindrical core of a large coil.

When transporting such aluminum or steel coils from the rolling mill to a factory for further processing such as the manufacture of beer cans the large coils are stood on end on pallets for transportation. During transportation ,hard acceleration and hard braking of the transporting vehicle causes the coils to slide and bump against one another. This sliding and bumping causes the coils to become so deformed that once they reach the factory it is impossible to unwind them.

To prevent this deformation, it is known in the art to put a brace in at least the top end of the cylindrical core of the coil. The known bracing devices for large coils are made of several circular pieces of plywood glued together. These known bracing devices all share the same difficulty in that as a result of their rigidity they are worked out of the core of the coil, and they are unable to compensate for transmitted radial forces. As a result of this force the outer edge of the wooden braces is reduced to a single plywood disk and further, the portion of the force directed from the axis of the coil towards the outside diameter causes the brace to be forced out of the coil. In addition, the known bracing devices are expensive to manufacture and have a comparatively high weight.

SUMMARY OF THE INVENTION

It is an object of the invention to provide a bracing device which will maintain the shape of the coil under strong radial forces. It is a further object of the present invention to provide a bracing device which can remain in the coil core even while the coil is being unwound. Yet another object of the present invention is to provide a bracing device which is lighter and less costly than bracing devices in the prior art.

Pursuant to this object, and others which will become apparent hereafter, one aspect of the invention resides in a circular formed disk having a U-shaped cross section and also having a cylindrical opening in its center.

The novel features which are considered as characteristic for the invention are set forth in particular in the appended claims. The invention itself, however, both as to its construction and its method of operation, together with additional objects and advantages thereof, will best understood from the following description of the specific embodiments when read in connection with the accompanying drawings.

BRIEF DESCRIPTION OF THE DRAWINGS

FIG. 1 is a cross section of a large coil with a bracing device according to the invention mounted therein;

FIG. 2 is a cross section of a bracing device shown offset by 90° relative to the view of FIG. 1, and on enlarged scale pursuant to the present invention; and FIG. 3 is a view showing two bracing devices according to the invention stacked upon one another.

DETAILED DESCRIPTION OF THE PREFERRED EMBODIMENTS

FIG. 1 illustrates a large coil 1 which is to be transported laying on its side on a pallet 2. A bracing device 4 is inserted in at least one end, preferably in the upper end, of a cylindrical opening 3 of the large coil 1 in order to prevent a force, acting in the direction of the arrows, against the large coil 1 from deforming the large coil in such a way that it is no longer possible to uncoil it.

FIG. 2 illustrates a cross section of the new bracing according to the invention. The bracing device according to the invention is composed of a ring having a U-shaped cross section and a cylindrical opening 5 in its center. The U-shaped ring is made of a slightly curved horizontal portion 6, an inner portion 7 and an outer portion 8. The inner portion 7 is oriented at an angle to the vertical axis of symmetry of the bracing device and is provided with a notch 9 at its free end. The outer portion 8 has a free end on which a flange 10 is fastened, preferably three such flanges oriented 120 degrees from each other on the ring formed by the outer portion 8 are utilized.

When the bracing device 4 illustrated in FIG. 2 is placed in the cylindrical core of the large coil 1 radially acting forces will be exposed thereby causing forces acting in the horizontal portion 6 to act as deformation forces which lead to transformation of the shape of the curved portion 6 to an S-shaped profile. Even when the radial forces are so strong that the outer portion 8 breaks away the remaining portions are so positioned in the cylindrical core 3 that unrolling of the large coil is still possible.

FIG. 3 illustrates the function of the notch 9. The function of this notch 9 is to facilitate stacking of a large number of bracing devices.

The bracing device as described above can be made cost effectively and with a low weight when constructed as a single piece by pressing a nonexpandable mixture of cellulose holding particles and a thermal setting binder.

By way of example, the nonexpandable mixture can be made of cellulose holding fibrous materials such as fragmented and dried wood chips, bagasse fibers, etc., that are mixed with a thermal setting synthetic resin plastic such as melamine-, urea-, formaldehyde-, or phenolformaldehyde. Arrangements of the fragmented and dried wood or bagasse fibers can also use fibers of other working materials such as fiberglass, stone wool or asbestos alone or in combination with each other, to which an appropriate, preferably organic binder is combined.

While the invention has been illustrated and described as embodied in large coils, it is not intended to be limited to the details shown, since various modifications and structural changes may be made without departing in way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

We claim:

1. A hub-shaped bracing device insertable in cylindrical holes of large coils for preserving the shape of large coils, comprising a circular disk formed as a single piece of a pressed mixture of lignocellulose-containing fibrous materials and thermo-setting binding agents and having a central vertical axis and a central opening extending through said vertical axis, said disk having a substantially U-shaped cross-section and including a vertical outer portion of substantially cylindrical cross-section, a vertical inner portion radially spaced from said outer portion and extending at a slight angle to said central vertical axis, and a substantially horizontal portion connecting said inner portion and said outer portion to each other, said horizontal portion being arched inwardly whereby said disk when inserted into a cylindrical hole of the coil is able to compensate for radial forces exerted on the coil, said outer vertical portion having a radially outer edge and at least two flanges formed at said edge and projecting radially outwardly beyond said outer edge whereby said flanges are supported on an edge of the coil when the bracing device is inserted into the coil.

2. An insertable hub-shaped bracing device as defined in claim 1, said inner vertical portion being longer than said outer vertical portion and being formed with a notch on its free end.

* * * * *